United States Patent [19]

Davis

[11] Patent Number: 4,805,305

[45] Date of Patent: Feb. 21, 1989

[54] REPLACEABLE RAZOR BLADE SCISSORS

[75] Inventor: Lamar Davis, New Smyrna Beach, Fla.

[73] Assignee: Sazor, Inc., New Smyrna Beach, Fla.

[21] Appl. No.: 55,992

[22] Filed: Jun. 1, 1987

[51] Int. Cl.[4] ..... B26B 13/04

[52] U.S. Cl. ..... 30/258; 30/195; 30/260

[58] Field of Search ..... 30/195, 256, 258, 260, 30/341

[56] References Cited

U.S. PATENT DOCUMENTS

| | | | |
|---|---|---|---|
| 1,284,993 | 11/1918 | Bellman | 30/258 X |
| 2,057,547 | 10/1936 | Tring | 30/258 |
| 2,195,353 | 3/1940 | Atchison | 30/335 X |
| 2,677,179 | 5/1954 | Servilla | 30/256 |
| 2,939,213 | 6/1960 | Daniel | 30/260 |

*Primary Examiner*—Frank T. Yost
*Assistant Examiner*—Michael D. Folkerts
*Attorney, Agent, or Firm*—Arthur G. Yeager

[57] ABSTRACT

A single hand-held scissors for cutting hair including a first and second member pivotally interconnected intermediate between their ends via a hinge joint. The end of both members having ring-like finger holds formed integrally with handles. The opposite end of the first member is formed as a first jaw containing an integral longitudinal recess for releasably securing a straight-edged razor blade therein. The second member has its opposite end formed into a second jaw containing a longitudinal recess in vertical alignment with the recess in the first jaw. The hinge joint includes cooperating face having laterally extending shoulders which engage to limit the opening and closing of the scissors. The shoulders for limiting the closing of the scissors prevent the razor blade edge from engaging the lower edges or bottom walls forming such recess in the second jaw when smoothly cleaving hair disposed between the jaws.

13 Claims, 2 Drawing Sheets

REPLACEABLE RAZOR BLADE SCISSORS

BACKGROUND OF THE INVENTION

1. FIELD OF THE INVENTION

The present invention relates to scissors and particularly to scissors which incorporate replaceable razor blades for use in cutting of hair.

2. DESCRIPTION OF THE PRIOR ART

There are a wide variety of scissors known to the prior art that employ additional implements as part of the specific embodiment used in a given application. For example, U.S. Pat. No. 3,304,606 discloses a scissors employing a plurality of razor blades affixed to a blade that make contact with a rigid metal surface for thinning eyelashes. The device appears dangerous to use and the direct contact with the metal surface by the razor blades will rapidly wear out the razor blade edges. A similar blade and anvil approach is used in U.S. Pat. No. 3,772,783 and the implement therein has most of the same limitations.

A scissors which allows for greater control by the user than the simple finger holds is that disclosed in U.S. Pat. No. 1,967,549. This device includes a curved shank associated with one finger hold but is not adaptable to other associated implements; it contains only the usual tapered blades. Furthermore, as with any scissors employing a beveled edge blade for shear cutting, this device is not readily adaptable for use with either hand. The right- or left- handedness of most scissors is a serious disadvantage for most barbers.

An attempt to incorporate the control associated with a large kidney-shaped ring in the handle as well as adapting a blade to carry a razor is disclosed in U.S. Pat. No. 2,195,353. This device uses rectangular members adapted to carry razor blades and blade supports in the place of ordinary scissor blades. The principal limitation of this device is the use of a very narrow rectangular member to engage the edge of a razor blade and this generates the required shear action for cutting. This arrangement requires high precision in the alignment of the parallel sides that engage the beveled edges of the razor blade in addition to generating a pulling action on any hair which could be most uncomfortable. The inwardly-angled sharp edges of the receiving member cannot exactly engage the sharp edge of the razor blade. This problem will result in hair pulling and a very ragged hair end cut. In fact, the scissors of this patent are not even adaptable for use in cutting hair.

Accordingly, none of the devices in the prior art provide the degree of control needed when using a razor blade in association with a cooperating scissors blade and the prior art also produces excessive dulling of the razor blade edge employed in such prior art scissors. Also, a scissors employing a razor blade as an implement must provide a good clean cut without pulling of the hair which has not been achieved by any of the prior art.

The present invention employs a razor blade to cleave the hair cleanly rather than a shear cut in the usual scissors action. This technique becomes important when attempting to use right-handed scissors with the left hand. The scissors are usually hinged and have beveled edges which assume a given shear cutting action will be used. Furthermore, the present invention can be opened for approximately 90° opening so as to use the razor blade for conventional shaving and cutting by a beautician. None of the devices in the prior art provide the aforementioned advantages of the present invention, which also alleviates some of the problems inherent in or set forth above with respect to the prior art.

SUMMARY OF THE INVENTION

In accord with one aspect of this invention, a scissors for cutting hair comprises a cross pair of elongated unitary members each having opposite end portions, pivot means interconnecting the members intermediate their end portions, each member end portion forwardly of the pivot means having cooperating jaws and rearwardly of the pivot means having cooperating handles. The pivot means includes a hinge joint having cooperating shoulders on the members adjacent thereto limiting relative pivotal movements of the handles apart from each other and toward each other. One jaw releasedly receives a straight-edged razor blade, another of the jaws has a longitudinal recess disposed substantially centrally between vertical faces of the jaw with the hinge joint aligning one jaw in a vertical plane of the other jaw to accurately position a straight-edged razor carried by one jaw in substantially vertical alignment with the longitudinal recess in the other jaw.

Another aspect provides for the one jaw and one handle being a part of one member with the one handle having an inwardly disposed ring portion adapted to receive and fit a third finger of a hand. The other handle has an inwardly disposed ring portion adapted to receive and fit a little finger of a hand, with the one handle having a shank between the hinge joint and its ring portion. The shank of one handle has a first inwardly disposed recess adapted to receive a middle finger and second inwardly disposed recess located forwardly of the first recess adapted to alternatively receive a middle finger of a hand. One member includes a portion between a free end thereof and adjacent the hinge joint which is engageable by a thumb of a hand, and the other member has a portion between a free end thereof and adjacent to the hinge joint adapted to be engaged by an index finger of a hand whereby accurate movement and control is provided by and to the jaws during cutting of hair disposed therebetween. Also, the other member has a protrusion adjacent the joint hinge for engagement by the index finger.

Further aspects are seen herein with the cooperating shoulders of the hinge joint being positioned to limit the pivotal movement of the handles towards one another to inhibit contact of a sharpened edge of a straight-edged razor carried by one jaw with a lower surface of the longitudinal recess in the other jaw. One jaw also has a longitudinal recess disposed centrally therein sized for frictionally and releasably engaging a replaceable unsharpened edge portion of a straight-edged blade. The longitudinal recess of the other jaw includes a pair of spaced side walls and a lower surface extending substantially perpendicularly to the side walls, the lower surface being spaced outwardly from full closure of the scissors of a razor blade sharpened edge into the recess, the recess being disposable perpendicularly with respect to hair to be cut by the scissors. The recess with a razor blade in one jaw provides a chopping engagement by a straight-edged blade carried by the one jaw against hair being cleanly cut thereby. The hinge joint includes two oppositely disposed recessed hinge faces in contact in the vertical plane, the hinge joint also includes a headed pin securing the hinge faces in rotatable engagement with the cooperating shoulders including a shoulder on respective members. The shoulder on the first member including a first forwardly disposed inclined surface. The shoulder on the second member includes a rearwardly disposed declined surface, and the inclined and declined surfaces are positioned relative to each other so that they are engaged to limit the travel of the members when the members are moved away from one another by a hand engaged with the handles, the travel being limited for one-hand manipulation of the scissors. The cooperating shoulders include another shoulder on respective members spaced from the shoulder thereon with the shoulder and the other shoulder being on opposite sides of the pivot hinge. The other shoulder on a second member includes a second forwardly disposed declined surface and the shoulder on the first member includes a first forwardly disposed declined surface. The declined first and second surfaces are sized and positioned so that they are engaged to limit the travel of the members when the members are moved toward each other by a hand engaged with the handles, the travel being limited to prevent a sharpened edge of a straight-edged blade carried by one jaw from striking a lower surface of the longitudinal recess in the other jaw.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PREFERRED EMBODIMENT

Figure 1:
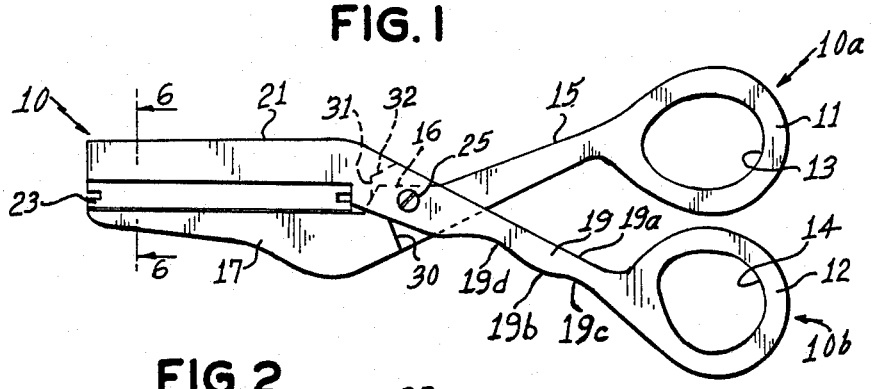
FIG. 1 is a side elevational view of the scissors in accord with this invention.
Figure 2:
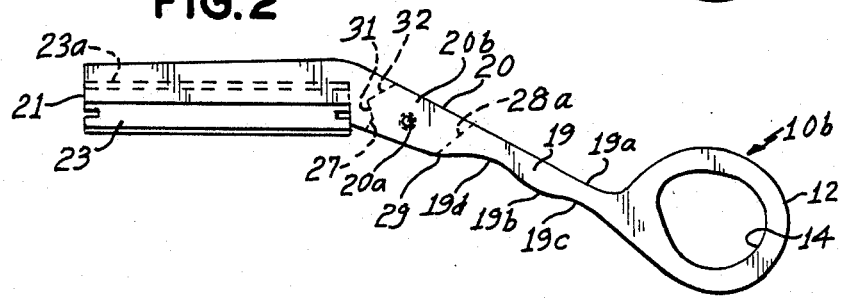
FIG. 2 is a side elevational view of the elongated member carrying a replaceable razor-blade.
Figure 3:
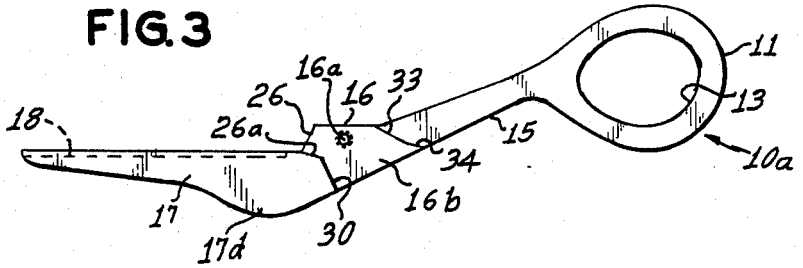
FIG. 3 is a side elevational view of the other elongated member.
Figure 4:
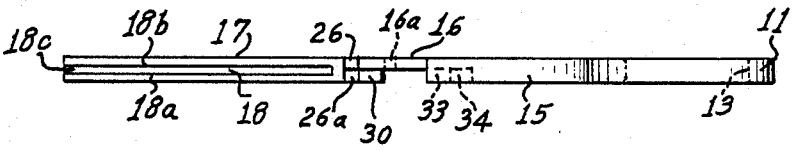
FIG. 4 is a top view of the other member illustrating the elongated recess into which a sharpened edge of a razor blade enters.

Referring now to the drawing, the razor blade carrying scissors according to the present invention is indicated generally by the numeral 10 in FIG. 1. The scissors is comprised of two members **10*a*, 10*b* pivotally connected intermediate between their ends and formed to provide handles 11 and 12 with ring-shaped finger holds 13 and 14, respectively. Handle 11 and finger hold 13 are integral to a substantially straight shank 15 which has integrally formed recessed pivot means in the form of a hinge joint 16. A tapered jaw 17 having a longitudinal recess 18, as more clearly illustrated in FIG. 4, is also integral to shank 15 and handle 11. Handle 12 has finger hold 14 integral with shank 19, hinge joint 20 and generally rectangular jaw 21 with longitudinal recess 22 as illustrated more clearly in FIG. 5. In the preferred embodiment of the invention, the members 10*a*, 10*b* of the scissors 10 are each formed from individual sections of steel, or aluminum or other suitable material. The upwardly disposed surface 19*a* of shank 19 is designed to have a generally smooth face. The downwardly disposed surface 19*b* is provided with two spaced curvilinear recesses 19*c* and 19*d* which provide finger rests. Finger rests 19*c*, 19*d* provide the user with the selectability of placing the middle finger in either rest 19*c*, 19*d* and a greater degree of control than a smooth surface found on many prior art scissors. The greater control achieved with the present invention is important when employing a razor 23 with a scissors 10**, especially when a person's hair is wet with the likelihood of the user's hand also becoming wet and the possibility of slipping engagement between hand and scissors.

Razor blade 23 is of a conventional design which may include a head, **23*a* which is smooth and slightly thicker than blade 23 as is well known in the art. The elongated razor head 23*a* of razor 23 fits within and fills the longitudinal recess 22 of upper jaw 21. The lateral width of recess 22 is sized to frictionally engage the razor head 23*a* and prevent movement of razor 23 when the scissors 10 are in use, and also permits replacement thereof without undue force being applied thereto. Upper jaw 21 is vertically aligned with lower jaw 17 by placing into contact the internal hinge faces 16*b* and 20*b* and securing them in place by way of bolt or pin 25 which is common in the art. Because hinges 16 and 20 are offset and cut out of shanks 15 and 19, respectively, the jaws 21 and 17 are aligned in the vertical plane with the razor 23 directly over lower jaw recess 18. The limits of travel of the upper jaw 21 and lower jaw 17 with respect to each other are established by the engagement of faces of the hinges 16 and 20. When the scissors 10 are being closed the pivoting of lower jaw 17 and upper jaw 21 cause face 27 of hinge 20 to come into contact with inclined forward face 26 of hinge 16 and preventing further rotative motion, as shown in FIG. 1. When the scissors 10 are being opened, the pivoting of the upper jaw 21 continues to an opening of approximately 90° where the lower edge 29 of rearwardly disposed inclined face 28*a* comes into contact with forward inclined face 30 of hinge 16 due to the dimensions of the cutout hinges 16 and 20. The linear dimensions and specific orientation of the various faces and shoulders 26, 26*a*, 30, 33, 34 of hinge 16 and faces and shoulders 20*a*, 27, 31, 32, 28*a*, 29 of hinge 20 allow for precision movement with ease and without the sharpened edge of the blade contacting the lower surface 18*c* or the side edges 18*a* and 18*b* of recess 18**.

When razor blade 23 is closed down on hair, the cutting action takes place by way of a downward "cleave cut" rather than the usual "shear cut" associated with conventional scissors. The hair between razor 23 and lower jaw recess 18 is chopped cleanly rather than shear-sliced which may cause split ends or the like. The jaws 17, 21 of the scissors 10 are aligned to limit the travel of razor 23 to an extremely small distance above the bottom surface—of recess 18 to eliminate the dulling of the razor 23 which would occur as a result of contact with the surface—but to allow for sufficient travel of razor 23 to provide a complete cut through the hair.

Figure 6:
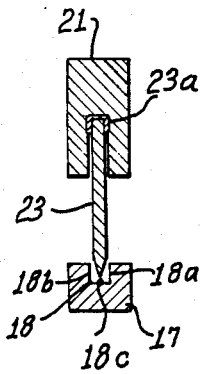
FIG. 6 is an enlarged cross-sectional view taken along line 6—6 of FIG. 1.
Figure 5:
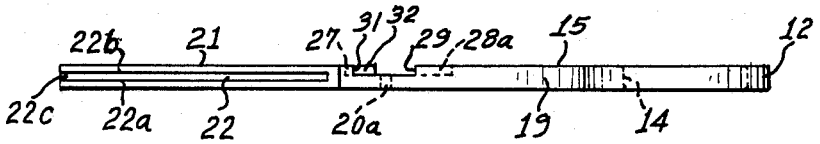
FIG. 5 is a bottom view of the razor blade carrying member illustrating the recess into which is fitted the unsharpened edge portion of a razor blade.
Figure 7:
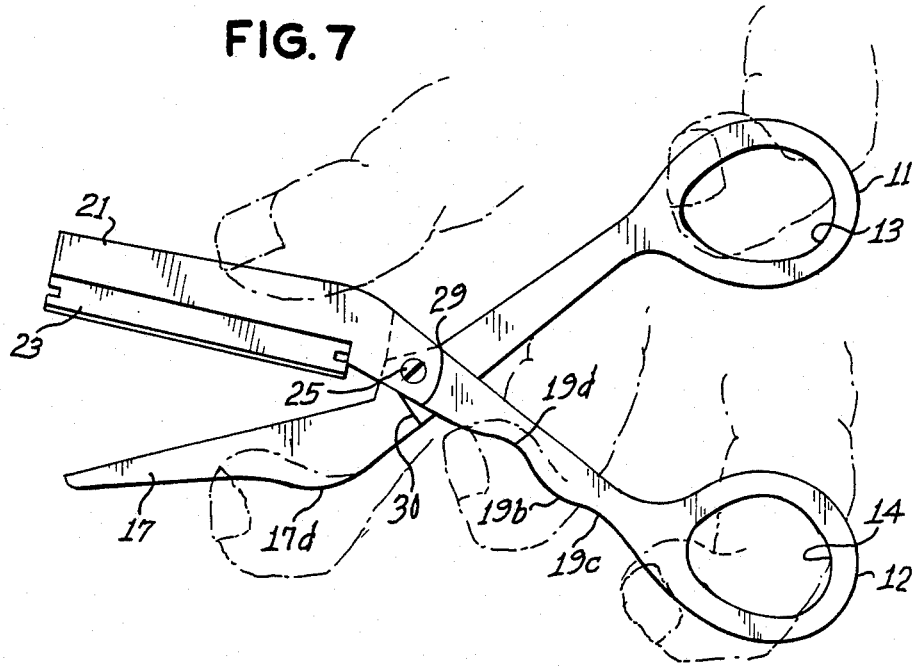
FIG. 7 is a side elevational view of scissors according to the invention as it appeared in use when open for hair cutting.
Figure 8:
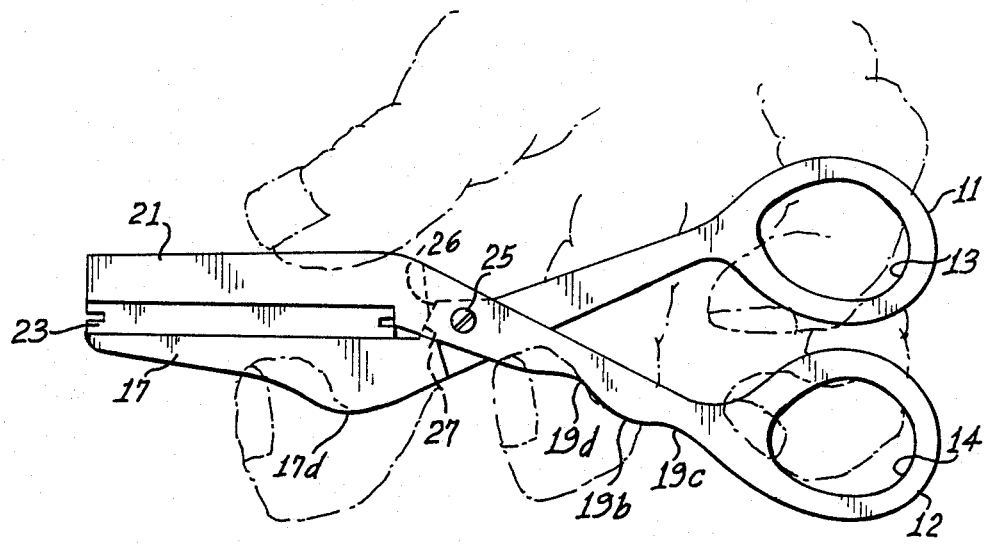
FIG. 8 is a side elevational view similar to FIG. 7 and showing the scissors being closed after cutting through the hair.

The longitudinal recess 18 in lower jaw 17, as seen in FIGS. 4 and 6, has vertically disposed side walls **18*a*** and 18*b* and lower surface 18*c*. The side walls 18*a*, 18*b* provide sufficient depth to lower surface 18*c* to prevent direct contact with sharpened edge 23*a* of razor 23 when the scissors 10 are used in cutting hair disposed generally laterally across the lower jaw 17. The longitudinal recess 22 in upper jaw 21, as seen in FIGS. 5 and 6, has side walls 22*a*, 22*b* and bottom 22*c* sized to provide releasably frictional engagement with a standard straight-edged razor blade 23.

The lower jaw 17 has protrusion 17*d* which provides a convenient and secure surface for a user to be engaged by an index finger to achieve greater control of scissors 10 between a thumb engaging upper jaw 21 generally above protrusion 17*d* and the index finger engaging such protrusion whereby the forces applied to the scissors are by the index finger and thumb in cutting the hair while opening is achieved by action of the other fingers.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A scissors for cutting hair comprising a cross pair of elongated unitary members each having opposite end portions, pivot means interconnecting said members intermediate their said end portions, each said member and portion forwardly of said pivot means having cooperating jaws and rearwardly of said pivot means having cooperating handles, said pivot means including a hinge joint having cooperating shoulders on said members closely adjacent thereto limiting relative pivotal movements of said handles apart from each other and limiting pivotal movement of said handles toward each other, one said jaw releasedly receiving a straight-edged razor blade, another of said jaws including an elongated jaw member having a longitudinal recess disposed substantially centrally between inwardly facing vertical faces of said other jaw, said vertical faces being spaced apart so that no contact is made with said razor when disposed between vertical faces, said razor blade having an elongated cutting edge when said scissors are fully closed very closely adjacent along a bottom surface of said recess whereby said cutting edge cleanly chops hair positioned across said recess by cooperation of said elongated cutting edge with said elongated jaw member, said hinge joint aligning said one jaw in a vertical plane of said other jaw to accurately position a straight-edged razor carried by said one jaw in substantially vertical alignment with said longitudinal recess in said other jaw.

2. The scissors as in claim 1 wherein said one jaw and one said handle are part of one said member, said one handle having an inwardly disposed ring portion adapted to receive and fit a third finger of a hand, said other handle having an inwardly disposed ring portion adapted to receive and fit a little finger of a hand, said one handle having a shank between said hinge joint and its said ring portion, said shank having a first inwardly disposed recess adapted to receive a middle finger and second inwardly disposed recess located forwardly of said first recess adapted to receive a middle finger of a hand, said one member having a portion between a free end thereof and adjacent said hinge joint adapted to be engaged by a thumb of a hand, said other member having a portion between a free end thereof and adjacent said hinge joint adapted to be engaged by an index finger of a hand whereby accurate movement and control is provided by and to said jaws during cutting of hair disposed therebetween.

3. The scissors as in claim 2 wherein said other member includes a protrusion adjacent said joint hinge for engagement by said index finger.

4. The scissors as in claim 1 wherein said cooperating shoulders of said hinge joint are positioned to limit the pivotal movement of said handles towards one another to inhibit contact of a sharpened edge of a straight-edged razor carried by said one jaw with a bottom surface of said longitudinal recess.

5. The scissors as in claim 1 wherein said one jaw includes a longitudinal recess disposed centrally therein sized for frictionally and releasably engaging an unsharpened edge of a straight-edged blade.

6. The scissors as in claim 1 wherein said hinge joint includes two oppositely disposed recessed hinge faces pivotally in contact in the vertical plane, said hinge joint further including a headed pin securing said hinge faces in rotatable engagement, said cooperating shoulders including a shoulder on respective said members, said shoulder on a first said member including a first forwardly disposed inclined surface, said shoulder on a second said member including a rearwardly disposed declined surface, said inclined and declined surfaces being positioned relative to each other so that they are engaged to limit the travel of said members when said members are moved away from one another by a hand engaged with said handles, said travel being limited for one-hand manipulation of said scissors.

7. A scissors as in claim 1 wherein said cooperating shoulders including another shoulder on respective said members spaced from said shoulder thereon with said shoulder and said other shoulder being on opposite sides of said pivot hinge, said other shoulder on a second said member including a second forwardly disposed declined surface, said shoulder on a first said member including a first forwardly disposed declined surface, said declined first and second surfaces being sized and positioned so that they are engaged to limit the travel of said members when said members are moved toward each other by a hand engaged with said handles, said travel being limited to prevent a sharpened edge of a straight-edged blade carried by said one jaw from striking a lower surface of said longitudinal recess in said other jaw.

8. A scissors for cutting hair comprising a crossed pair of elongated unitary members each having opposite end portions, pivot means interconnecting said member intermediate their said end portions, each said member end portion forwardly of said pivot means having cooperating jaws and rearwardly of said pivot means having cooperating handles, means for limiting relative pivotal movements of said handles apart from each other and limiting pivotal movement of said handles toward each other, one said jaw releasedly receiving a straight-edged razor blade, another of said jaws including an elongated jaw member having a longitudinal recess disposed substantially centrally between inwardly facing vertical faces of said other jaw, said vertical faces being spaced apart sufficiently to inhibit any contact with said razor blade when disposed in or passing into said recess between said vertical faces, said razor having an elongated edge when said scissors are fully closed very closely adjacent along a bottom of said recess, said cutting edge being adapted to cleanly chop hair positioned laterally across said recess while inhibiting nay discomforting pulling of such hair by cooperation of said cutting edge with said jaw member, said pivot means aligning said one jaw in a vertical plane of said other jaw to accurately position a straight-edged razor carried by said one jaw in substantially vertical alignment with said longitudinal recess in said other jaw.

9. The scissors as in claim 8 wherein said one jaw and one said handle are part of one said member, said one handle having an inwardly disposed ring portion adapted to receive and fit a third finger of a hand, said other handle having an inwardly disposed ring portion adapted to receive and fit a little finger of a hand, said one handle having a shank between said pivot means and its said ring portion, said shank having a first inwardly disposed recess adapted to receive a middle finger and second inwardly disposed recess located forwardly of said first recess adapted to receive a middle finger of a hand, said one member having a portion between a free end thereof and adjacent said pivot means adapted to be engaged by a thumb of a hand, said other member having a portion between a free end thereof and adjacent said pivot means adapted to be engaged by an index finger of a hand whereby accurate movement and control is provided by and to said jaws by a thumb and index finger of a hand during cutting of hair disposed therebetween.

10. The scissors as in claim 9 wherein said other member includes a protrusion adjacent said pivot means for engagemment by said index finger.

11. The scissors as in claim 9 wherein said one jaw includes a longitudinal recess disposed centrally therein sized for frictionally and releasably engaging an unsharpened edge of a straight-edged blade.

12. The scissors as in claim 9 wherein said means for limiting relative pivotal movements include spaced cooperating shoulders of adjacent said pivot means positioned to limit the pivotal movement of said handles towards one another to inhibit contact of a sharpened edge of a straight-edged razor carried by said one jaw with a bottom surface of said longitudinal recess.

13. A scissors as in claim 12 wherein said pivot means includes a hinge joint having two oppositely disposed recessed hinge faces in contact in the vertical plane, said hinge joint further having a headed pin securing said hinge faces in rotatable engagement, said cooperating shoulders including a shoulder on respective said members, said shoulder on a first said member including a first forwardly disposed inclined surface, said shoulder on a second said member including a rearwardly disposed declined surface, said inclined and declined surfaces being positioned relative to each other so that they are engaged to limit the travel of said members when said members are moved away from one another by a hand engaged with said handles, said travel away from one another being limited for one-hand manipulation of said scissors, said cooperating shoulders further including another shoulder on respective said members spaced from said shoulder thereon with said shoulder and said other shoulder being on opposite sides of said pivot hinge, said other shoulder on a second said member including a second forwardly disposed declined surface, said shoulder on a first said member including a first forwardly disposed declined surface, said declined first and second surfaces being sized and positioned so that they are engaged to limit the travel of said members when said members are moved toward each other by a hand engaged with said handles, said travel toward each other being limited to prevent a sharpened edge of a straight-edged blade carried by said one jaw from striking a bottom surface of said longitudinal recess.

* * * * *